US008991552B2

(12) United States Patent
Latka

(10) Patent No.: US 8,991,552 B2
(45) Date of Patent: Mar. 31, 2015

(54) WEAPON SILENCER AND METHOD OF MAKING WEAPON SILENCER

(71) Applicants: GSL Technology, Inc., Jackson, MI (US); Gemtech, Boise, ID (US)

(72) Inventor: Gregory S. Latka, Jackson, MI (US)

(73) Assignees: GSL Technology, Inc., Jackson, MI (US); Gemtech, Boise, ID (US)

( * ) Notice: Subject to any disclaimer, the term of this patent is extended or adjusted under 35 U.S.C. 154(b) by 0 days.

(21) Appl. No.: 14/178,828

(22) Filed: Feb. 12, 2014

(65) Prior Publication Data

US 2014/0224575 A1 Aug. 14, 2014

Related U.S. Application Data

(60) Provisional application No. 61/763,513, filed on Feb. 12, 2013.

(51) Int. Cl.
*F41A 21/30* (2006.01)
*F41A 21/00* (2006.01)

(52) U.S. Cl.
CPC ..... *F41A 21/30* (2013.01)
USPC ..... 181/223; 89/14.4

(58) Field of Classification Search
USPC ..... 181/223, 264, 269, 272, 281; 89/14.4, 89/14.3, 14.2, 14.05
See application file for complete search history.

(56) References Cited

U.S. PATENT DOCUMENTS

| | | | | |
|---|---|---|---|---|
| 1,017,003 | A | 2/1912 | Kenney | |
| 1,341,363 | A | 5/1920 | Fiala | |
| 2,792,760 | A | 5/1957 | Hammer | |
| 3,500,955 | A | 3/1970 | Werbell | |
| 3,667,570 | A | 6/1972 | WerBell, III | |
| 4,291,610 | A | 9/1981 | Waiser | |
| 4,576,083 | A | 3/1986 | Seberger, Jr. | |
| 4,588,043 | A * | 5/1986 | Finn | 181/223 |
| 4,685,534 | A * | 8/1987 | Burstein et al. | 181/251 |
| 4,907,488 | A * | 3/1990 | Seberger | 89/14.4 |
| 5,029,512 | A | 7/1991 | Latka | |
| 5,164,535 | A * | 11/1992 | Leasure | 89/14.4 |
| 6,308,609 | B1 * | 10/2001 | Davies | 89/14.4 |
| 6,374,718 | B1 * | 4/2002 | Rescigno et al. | 89/14.4 |
| 6,575,074 | B1 * | 6/2003 | Gaddini | 89/14.4 |
| 7,237,467 | B1 * | 7/2007 | Melton | 89/14.4 |
| 7,308,967 | B1 * | 12/2007 | Hoel | 181/223 |
| 7,594,464 | B2 * | 9/2009 | Dueck | 89/14.4 |
| 7,987,944 | B1 * | 8/2011 | Brittingham et al. | 181/223 |
| 8,100,224 | B1 * | 1/2012 | Olson | 181/223 |
| 8,210,087 | B2 * | 7/2012 | Latka | 89/14.3 |
| 8,453,789 | B1 * | 6/2013 | Honigmann et al. | 181/223 |
| 8,474,361 | B2 * | 7/2013 | Brittingham | 89/14.4 |
| 8,516,941 | B1 * | 8/2013 | Oliver | 89/14.4 |
| 8,579,075 | B2 * | 11/2013 | Brittingham et al. | 181/223 |
| 8,714,301 | B2 * | 5/2014 | Shults | 181/223 |
| 8,739,922 | B2 * | 6/2014 | Wirth et al. | 181/223 |
| 2014/0076658 | A1 * | 3/2014 | Smith et al. | 181/223 |

* cited by examiner

*Primary Examiner* — Edgardo San Martin
(74) *Attorney, Agent, or Firm* — Young Basile Hanlon & MacFarlane P.C.

(57) ABSTRACT

A firearm silencer includes a first cylindrical body section formed as a single unit having a first inner bore and a receiving end having a first axial bore, and a second cylindrical body section formed as a single unit having a second inner bore and a discharge end having a second axial bore. The first cylindrical body section is joined to the second cylindrical body section to form a cylindrical body. A plurality of baffles disposed within the cylindrical body, each baffle having a baffle axial bore.

20 Claims, 3 Drawing Sheets

WEAPON SILENCER AND METHOD OF MAKING WEAPON SILENCER

CROSS-REFERENCE TO RELATED APPLICATIONS

This application claims the benefit of U.S. Provisional Application No. 61/763,513 filed 12 Feb. 2013.

TECHNICAL FIELD

This disclosure relates generally to a silencer for a weapon such as a firearm.

BACKGROUND

Firearm silencers can absorb and reduce the audible frequencies and vibrations resulting from the rapid expansion of gases leaving a firearm muzzle as a projectile exits the gun bore. Such devices, in addition to reducing audible frequencies, can also contain and reduce muzzle flash. Silencers are designed to temporarily contain and divert expanding gases and other combustion by-products emitted from the muzzle of a firearm, and, as a result, effective firearm silencers can be relatively large and bulky to accommodate the large volume of expanding gasses, especially with higher caliber firearms.

SUMMARY

One aspect of disclosed implementations is a firearm silencer having a first cylindrical body section formed as a single unit having a first inner bore and a receiving end having a first axial bore, a second cylindrical body section formed as a single unit having a second inner bore and a discharge end having a second axial bore, wherein the first cylindrical body section is joined to the second cylindrical body section to form a cylindrical body and a plurality of baffles disposed within the monolithic cylindrical body, each baffle having a baffle axial bore.

Another aspect of disclosed implementations is a method of making a firearm silencer by forming a first cylindrical body section having a first inner bore from monolithic metallic stock, forming a second cylindrical body section having a second inner bore from monolithic metallic stock, inserting a plurality of baffles, each baffle having a baffle axial bore, within the first or second cylindrical body sections, and joining the first cylindrical body section with the second cylindrical body section to form a cylindrical body having a plurality of baffles disposed therein.

Another aspect of disclosed implementations is a method of silencing a firearm by firing a projectile from a firearm through a silencer formed by joining a first cylindrical body section formed as a single unit having a first inner bore and a receiving end having a first axial bore with a second cylindrical body section formed as a single unit having a second inner bore and a discharge end having a second axial bore, wherein the first cylindrical body section is joined to the second cylindrical body section to form a cylindrical body. The cylindrical body includes a plurality of baffles that are disposed within the cylindrical body, each baffle having a baffle axial bore, wherein the first axial bore, the second axial bore and one or more baffle axial bores of the plurality of baffles align to permit the projectile to enter the cylindrical body via the first axial bore, pass through one or more baffle axial bores of the plurality of baffles and exit the cylindrical body via the second axial bore, and wherein heated gasses and sonic energy emitted from the firearm along with the projectile are captured at least in part in the cylindrical body and dissipate therein.

BRIEF DESCRIPTION OF THE DRAWINGS

The description herein makes reference to the accompanying drawings wherein like reference numerals refer to like parts throughout the several views, and wherein.

DETAILED DESCRIPTION

Aspects of disclosed implementations can provide an effective firearm silencer wherein audible frequencies and muzzle flash can be effectively confined in a body of precise axial configuration whereby the expansion of gases is rapidly dissipated.

Aspects of disclosed implementations can provide a firearm silencer machined from solid stock material so as to insure precise dimensional tolerances along the longitudinal dimension of the silencer.

Aspects of disclosed implementations can provide a weapon silencer which is of economical construction, may be readily assembled, and minimizes the number of seams used in the completed assembly.

Aspects of disclosed implementations can provide a weapon silencer which is light in weight, strong, and of uniform wall thickness and precise concentricity along its length.

Aspects of disclosed implementations can provide a weapon silencer which may be manufactured from a wide variety of raw materials, without relying solely on conventionally available tube stock.

Figure 1:
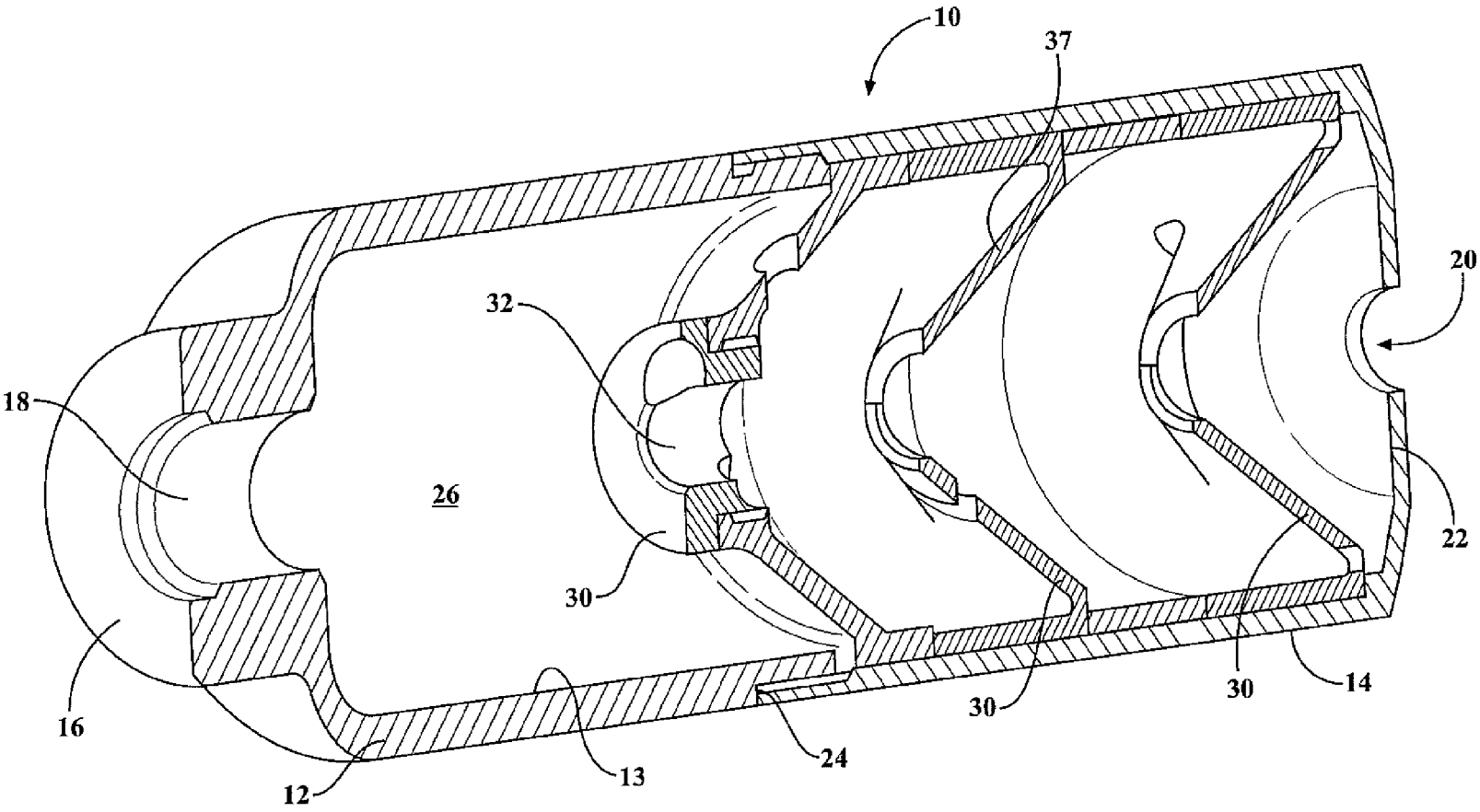
FIG. 1 is a perspective cutaway view of a weapon silencer.
Figure 2:
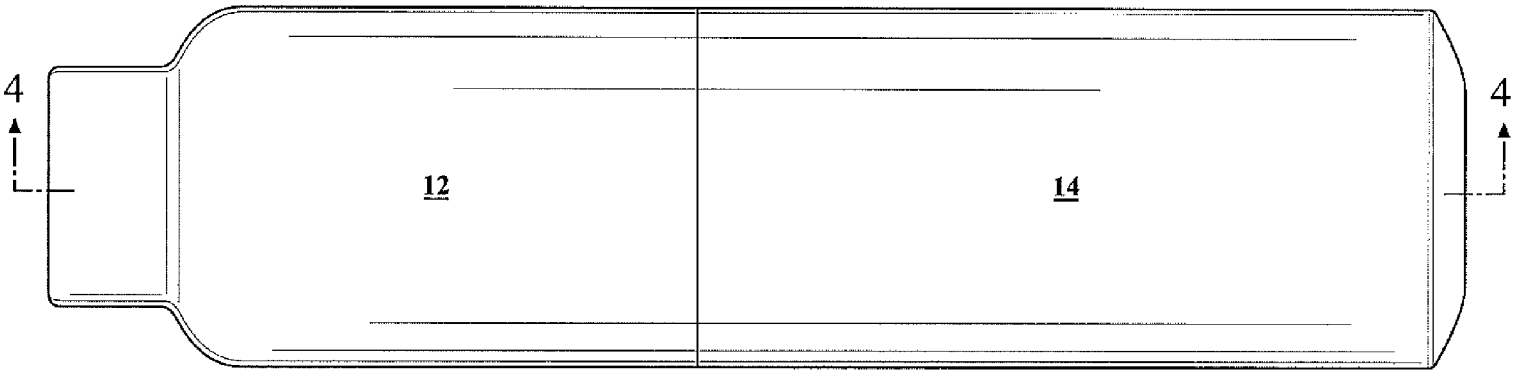
FIG. 2 is a side view of the weapon silencer.

A firearm silencer 10 is illustrated in FIG. 1. The silencer 10 can include a cylindrical body 12 having a cylindrical bore 13 axially extending from an open end distal from a receiver 16 of the cylindrical body to a closed end proximate to the receiver 16. The cylindrical body 12 is also referred to herein as a first cylindrical body section. The receiver 16 includes a wall that extends generally transverse to the axial direction of the cylindrical bore 13 of the cylindrical body 12. The cylindrical bore 13 has a receiver bore 18 that extends axially through the receiver 16 and can be concentric with the cylindrical body 12, the cylindrical bore 13 and an axis of the barrel of a firearm to which the silencer 10 can be attached. The receiver bore 18 is sized to allow connection to a firearm and to permit passage of a projectile. The diameter of the receiver bore 18 is small in comparison to the diameter of the cylindrical bore 13 of the cylindrical body 12. The receiver bore 18 can be threaded for at least a portion of its length and can be threadably attachable to a firearm muzzle, thereby rendering the silencer 10 selectively installable and removable from the weapon or firearm. A firearm barrel is the portion of a firearm or weapon that directs a fired projectile and the muzzle is the end portion of the barrel. The terms weapon and firearm will be used interchangeably herein.

The cylindrical body 12 can be formed as a single unit. In one implementation, the cylindrical body 12 can be formed of solid bar stock, being machined in any conventional fashion to form the outer circumference of cylindrical body 12, the cylindrical bore 13, the receiver 16, and the receiver bore 18 and further elements of the body that will be described herein. The thickness of the walls of cylindrical body 12 may be selected by modifying the machining process, and a desired and precise thickness of the walls of the cylindrical body 12 may be selectively varied to form variations in the wall thickness throughout the length of the cylindrical body 12, or to maintain a uniform thickness along the length of the cylindrical body 12. By utilization of solid bar stock, the material for the disclosed implementations may be selected from a wide range of available metallic alloys.

In other implementations the cylindrical body 12 can be formed by one or more of machining, stamping, forging, casting or additive manufacturing. Each of these forming operations can utilize a wide range of available metallic alloys and are not limited to conventionally available tube stock.

As shown in FIGS. 1-4, the silencer 10 further comprises an extension 14 having an extension bore 15 with one open end distal to an end cap 22 and one closed end proximate to the end cap 22. The extension 14 is also referred to herein as a second cylindrical section. The extension 14 can have a discharge 20 at the end cap 22 to allow the projectile fired from the weapon to pass and exit the silencer. The discharge 20 can be an axially extending bore through the end cap 22 that is concentric with respect to the extension bore 15 of the extension 14. The diameter of the discharge 20 is sized to allow a projectile to pass out of the silencer 10, and the diameter of the discharge 20 is small in comparison to the diameter of the extension bore 15. Like the cylindrical body 12, the extension 14 can be formed as a single unit, and can be formed of solid bar stock, being machined in any conventional fashion to form the outer circumference of the extension 14, the extension bore 15, the end cap 22, and the discharge 20 and further elements of the extension that will be described herein. The thickness of the walls of the extension 14 may be selected by modifying the machining process, and a desired and precise thickness of the walls of the extension 14 may be selectively varied to form variations in the wall thickness throughout the length of the extension 14, or to maintain a uniform thickness along the length of the extension 14. By utilization of solid bar stock, the material for disclosed implementations can be selected from a wide range of available metallic alloys.

In other implementations the extension 14 can be formed by one or more of machining, stamping, forging, casting or additive manufacturing. Each of these forming operations can utilize a wide range of available metallic alloys and are not limited to conventionally available tube stock.

As shown in FIGS. 1-4, positioned within an inner chamber 26 formed interior to cylindrical body 12 and the extension 14 are a plurality of baffles 30. Each baffle 30 can have an axial bore 32 and a frusto-conical section 37, with the apex of the frusto-conical sections 37 of the baffles 30 disposed toward the receiver bore 18 of the receiver 16 and the base of frusto-conical section disposed toward the discharge 20 of the end cap 22. Each axial bore 32 in each baffle 30 is large enough to accommodate the passage of the projectile fired from the weapon. Each axial bore 32 in each baffle 30 can be in coaxial alignment so that a projectile fired from a weapon can pass unobstructed through the receiver bore 18, chamber 26 and axial bores 32 of the plurality of baffles 30, until exiting the discharge 20 in the end cap 22.

Figure 3:
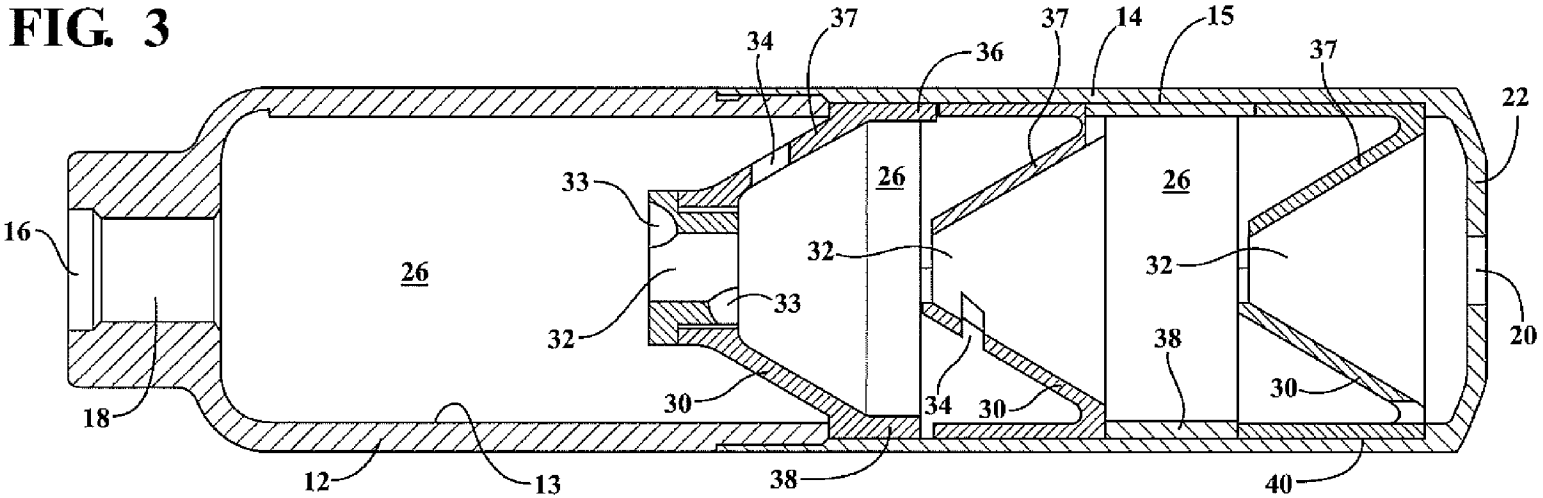
FIG. 3 is a side cross-sectional view of the weapon silencer.

The inter-relationship of the cylindrical body 12, the extension 14, and baffles 30 will be best appreciated by reference to FIG. 3. In the implementation so depicted, one or more baffles 30 can be positioned substantially within the inner chamber 26 of the extension 14, although partially extending into the inner chamber 26 of cylindrical body 12. Each baffle 30 has an annular section or annulus 36 and the frusta-conical section 37. Baffles 30 can be formed by casting or stamping, and are manufactured so as to insure a precise fit between the outer circumference of the annulus 36 and the inner circumference of the extension bore 15. By closely fitting the annulus 36 to the extension bore 15, expanding gasses, combustion by-products and sound energy can be prevented from passing between the annulus 36 and the extension bore 15 thereby increasing the efficiency with which the silencer 10 can suppress noise and muzzle flash. Baffles 30 may be spaced apart by one or more spacers 38. One or more of the one or more spacers 38 can be formed as a separate unit or can be formed as part of each baffle 30. When assembled, the silencer 10 can present the appearance shown in FIG. 3.

In aspects of disclosed implementations, it can be desirable that the flow of combustion gases associated with the firing of a projectile be attenuated and captured by the baffles 30. To facilitate this attenuation, each of the baffles 30 can be provided with one or more ports 34 which can communicate with the inner chamber 26. In disclosed implementations, this communication takes place by virtue of the orientation the ports 34, which will be best appreciated by reference to FIG. 4. For example, in baffle **30*b*, the port 34 is formed in the shape of a rectangle in the frusto-conical section 37 of baffle 30*b*. In baffle 30*a*, the port 34 is formed in the shape of a circle in the frusto-conical section of baffle 30*a*. Each baffle 30 can also be ported by a relief section 33 formed in the axial bore 32. Baffle 30*c* has a relief section in diameter of the axial bore 32**.

In operation, the ports 34 and the relief sections 33 can assist in dissipating combustion gasses and sound energy. As combustion gases and sound energy enter chamber **26*a* via the axial bore 32 in baffle 30*c*, the expanding gasses and sound energy can encounter turbulent flow caused by the shape of chamber 26*a*. A portion of the gasses and sound energy can be communicated back into chamber 26 via the relief section 33 and the port 34 in baffle 30*c*, thereby attenuating sound energy and dissipating the pressures of gases to be transmitted to the axial bore 32 of baffle 30*b*. The gases continue their flow through axial bore 32 of baffle 30*b* passing into chamber 26*b* wherein a further portion of the gasses and sound energy is passed back to chamber 26*a* through the ports 34 formed in baffle 30*b*. The remainder of the gasses and sound energy can then pass to chamber 26*c* via the axial bore 32 of baffle 30*c* where a further portion of the gasses and sound energy can pass back into chamber 26*b* via the port 34 in baffle 30*a* and then, having dissipated a substantial amount of heat and sound energy, the remaining gasses and sound energy finally pass through the discharge 20 and out of the silencer 10**.

The cylindrical body 12 and the extension 14 can secured together in end to end relationship as shown in the figures, and as will be explained in further detail herein. The cylindrical body 12 and the extension 14 may also be secured together by welding, thereby forming a monolithic structure permanently joined together, for example. Forming the silencer as a monolithic unit in this fashion can provide a more reliable silencer since it cannot be inadvertently separated in use. Other ways of joining the cylindrical body 12 and the extension 14 include utilizing modern high strength adhesives, fasteners, threads or conventional metal joinder techniques such as brazing or soldering. The techniques of manufacturing the device according to the above-described structure results in a silencer which is assembled having a single seam, and wherein the silencer body is of precise dimension and alignment with the weapon bore. The cylindrical body 12 and the extension 14 can be joined permanently, for example by welding the two parts to form the silencer 10, or they can be joined so as to permit the two parts to be separated, for example by threading the two part together.

Figure 4:
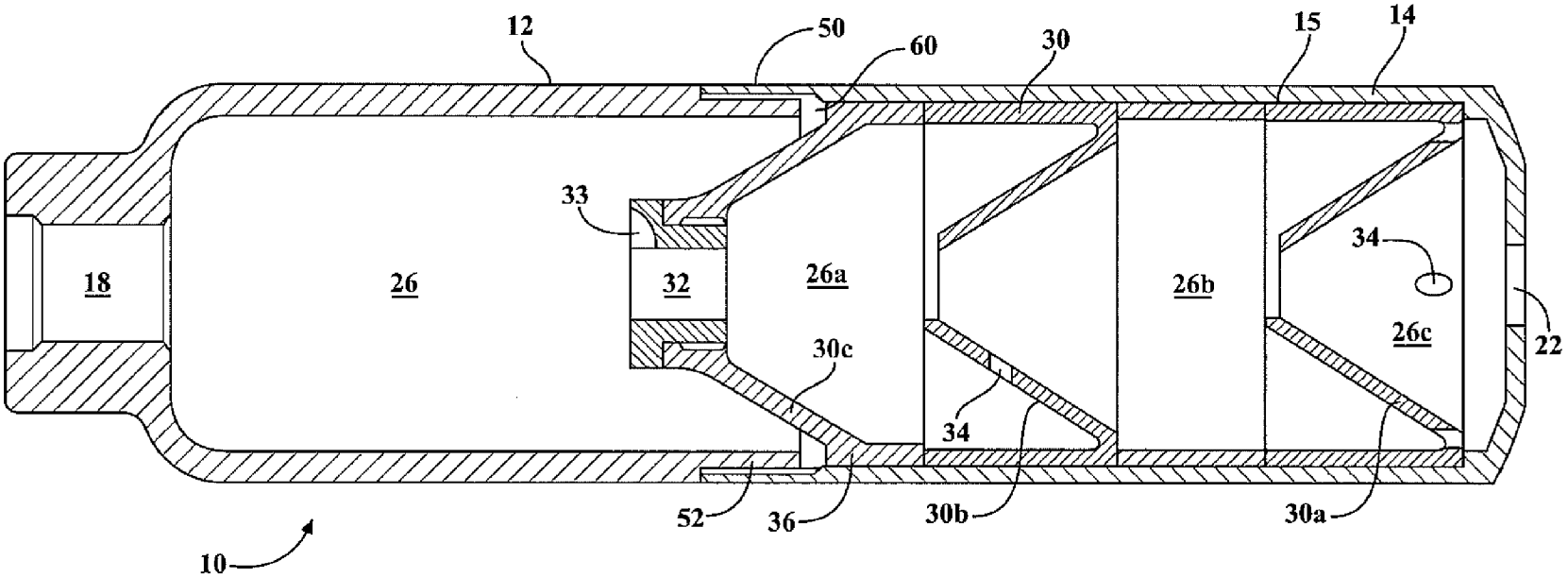
FIG. 4 is a side cross-sectional view of the weapon silencer.

Further aspects of disclosed implementations include a stop ring 60. FIG. 4 shows the stop ring 60 positioned at the point where the cylindrical body 12 is joined to the extension 14. The cylindrical body 12 can formed with a reduced portion 52, where the stop ring 60 is of an outer diametric dimension substantially equal to the outer diameter of the reduced portion 52 of the cylindrical body 12. By sizing the baffles 30 and the spacers 38 properly, the baffles 30 can be captured by the stop ring 60 and thereby held securely in position in the extension 14 prior to the cylindrical body 12 and the extension 14 being mated. The baffle 30 closest to the cylindrical body 12 engages the stop ring 60 when the cylindrical body 12 and the extension 14, containing the baffles 30, are assembled together. The extension 14 is provided with an annular lip 50, which surrounds and partially engages the reduced portion 52 of the cylindrical body 12. The annular lip 50 and the reduced portion 52 may be formed with mechanically interlocking elements, which secure the cylindrical body 12 and the extension 14 in end to end communication, thereby forming a substantially contiguous internal chamber 26 extending from the receiver bore 18 to the discharge 20 in the end cap 22 portion of the extension 14.

Although the above implementations disclose combining the cylindrical body 12 and the extension 14 to form the silencer 10, it is contemplated that three or more portions can be joined together to form the silencer 10. The silencer 10 can include one or more baffles having frusto-conical sections and ports and other structures designed to direct and/or port gasses, by-products of combustion and sound energy in such a fashion as to reduce the sound energy and muzzle flash emitted from the silencer in conjunction with the firing of a projectile. When using baffles and other structures in this fashion, the principles and concepts are similar to those previously described and it will be appreciated that various other modifications of the disclosed implementations may be apparent to those skilled in the art without departing from the spirit and scope of the disclosure herein.

I claim:

1. A firearm silencer, comprising:

a first cylindrical body section integrally formed as a single unit having a first exterior surface, a first inner bore that defines a first inner diameter, a receiving end having a first axial bore that is smaller than and in communication with the first inner bore, and a first open end opposing the receiving end, the first inner bore extending from the receiving end to the first open end, and the receiving end being substantially transverse to the first inner bore and configured for engagement with the firearm;

a second cylindrical body section integrally formed as a single unit having a second exterior surface, a second inner bore that defines a second inner diameter, a discharge end having a second axial bore that is smaller than and in communication with the second inner bore, and a second open end opposing the discharge end, the second inner bore extending from the discharge end to the open end, and the discharge end being substantially transverse to the second inner bore, wherein the first open end of the first cylindrical body section is joined to the second open end of the second cylindrical body section to form a cylindrical body; and a plurality of baffles disposed within the cylindrical body, each baffle having a baffle axial bore.

2. The firearm silencer of claim 1, wherein the first cylindrical body section and the second cylindrical body section are permanently joined together by welding.

3. The firearm silencer of claim 1, wherein the first cylindrical body section and the second cylindrical body section are each machined from metallic bar stock.

4. The firearm silencer of claim 1, wherein the first cylindrical body section and the second cylindrical body section are each formed by at least one of machining, stamping, forging, casting or additive manufacturing.

5. The firearm silencer of claim 1, wherein the first cylindrical body section and the second cylindrical body section are joined by at least one of welding, brazing, high strength adhesives, threads or fasteners.

6. The firearm silencer of claim 1, wherein each baffle from the plurality of baffles has a frusto-conical section extending outward from the baffle axial bore toward the cylindrical body, and each baffle from the plurality of baffles has an annular section connected to the frusto-conical section configured to fit closely within the first inner bore or the second inner bore.

7. The firearm silencer of claim 6, wherein one or more of the plurality of baffles includes a vent in the frusta-conical section.

8. The firearm silencer of claim 6, wherein one or more of the plurality of baffles includes a relief in the baffle axial bore.

9. The firearm silencer of claim 1, wherein the plurality of baffles are configured to form a plurality of chambers in the cylindrical body in cooperation with the first inner bore and second inner bore.

10. The firearm silencer of claim 1, wherein the first axial bore, the second axial bore, and one or more baffle axial bores of the plurality of baffles align to permit a projectile to be fired by the firearm, enter the cylindrical body via the first axial bore, pass through the baffle axial bores of the plurality of baffles, and exit the cylindrical body via the second axial bore.

11. The firearm silencer of claim 1, wherein the plurality of baffles and one or more spacers are configured to form chambers within the cylindrical body.

12. The firearm silencer of claim 11, wherein one or more of the one or more spacers are formed as a single unit with one or more baffles.

13. A method of making a firearm silencer, comprising:

forming a first cylindrical body section integrally as a single unit from monolithic metallic stock, the first cylindrical body section having a receiving end, a first open end opposing the receiving end, and a first inner bore extending from the receiving end to the first open end, the receiving end being substantially transverse to the first inner bore, configured for engagement with the firearm, and having a first axial bore that is smaller than and in communication with the first inner bore;

forming a second cylindrical body section integrally as a single unit from monolithic metallic stock, the second cylindrical body section having a discharge end, a second open end opposing the discharge end, and a second inner bore extending from the discharge end to the second open end, the discharge end being substantially transverse to the second inner bore and having a second axial bore that is smaller than and in communication with the second inner bore;

inserting a plurality of baffles, each baffle having a baffle axial bore, within at least one of the first cylindrical body section or the second cylindrical body section; and joining the first open end of the first cylindrical body section with the second open end of the second cylindrical body section to form a cylindrical body having a plurality of baffles disposed therein.

14. The method of claim 13, wherein the first cylindrical body section and the second cylindrical body section are each machined from metallic bar stock.

15. The method of claim 13, wherein the first cylindrical body section and the second cylindrical body section are permanently joined together by welding.

16. The method of claim 13, wherein the first cylindrical body section and the second cylindrical body section are each formed by at least one of machining, stamping, forging, casting or additive manufacturing.

17. The method of claim 13 wherein the first cylindrical body section and the second cylindrical body section are joined by at least one of welding, brazing, high strength adhesives, threads or fasteners.

18. A method of silencing a firearm comprising:

firing a projectile from a firearm through a silencer formed by joining a first open end of a first cylindrical body section formed as a single unit with a second open end of a second cylindrical body section formed as a single unit, wherein the first cylindrical body section is integrally formed as a single unit and has a receiving end opposing the first open end and a first inner bore extending from the receiving end to the first open end, wherein the receiving end of the first cylindrical body section is substantially transverse to the first inner bore, configured for engagement with the firearm, and has a first axial bore smaller than and in communication with the first inner bore, wherein the second cylindrical body section is integrally formed as a single unit and has a discharge end opposing the second open end and a second inner bore extending from the discharge end to the second open end, wherein the discharge end of the second cylindrical body section is substantially transverse to the second inner bore and has a second axial bore smaller than and in communication with the second inner bore, wherein the first cylindrical body section is joined to the second cylindrical body section to form a cylindrical body, wherein the cylindrical body includes a plurality of baffles that are disposed within the cylindrical body, each baffle having a baffle axial bore, wherein the first axial bore, the second axial bore, and one or more baffle axial bores of the plurality of baffles align to permit the projectile to enter the cylindrical body via the first axial bore, pass through one or more baffle axial bores of the plurality of baffles, and exit the cylindrical body via the second axial bore, and wherein heated gasses and sonic energy emitted from the firearm along with the projectile are captured at least in part in the cylindrical body and dissipate therein.

19. The firearm silencer of claim 1, wherein the first exterior surface of the first cylindrical body section and the second exterior surface of the second cylindrical body section substantially comprise an exterior surface of the cylindrical body, and wherein the distance between the receiving end and the first open end is substantially the same as the distance between the discharge end and the second open end.

20. The firearm silencer of claim 1, wherein the first inner diameter of the first cylindrical body section is substantially constant between the receiving end and the first open end and the second inner diameter of the second cylindrical body section is substantially constant between the discharge end and the second open end.

* * * * *